US005724845A

United States Patent [19]

Yasumi et al.

[11] Patent Number: 5,724,845

[45] Date of Patent: Mar. 10, 1998

[54] BOWING CORRECTION APPARATUS FOR TEMPER ROLLING MILL

[75] Inventors: Tadaaki Yasumi; Yuji Shimoyama, both of Chiba, Japan

[73] Assignee: Kawasaki Steel Corporation, Hyogo, Japan

[21] Appl. No.: 689,642

[22] Filed: Aug. 12, 1996

[51] Int. Cl.[6] ..... B21D 1/05

[52] U.S. Cl. ..... 72/161; 72/164; 72/205

[58] Field of Search ..... 72/161, 205, 164, 72/165

[56] References Cited

U.S. PATENT DOCUMENTS

| | | | |
|---|---|---|---|
| 3,429,164 | 2/1969 | Oganowski | 72/161 |
| 3,839,888 | 10/1974 | Greenberger | 72/161 |
| 3,841,132 | 10/1974 | Kuhn | 72/205 |
| 4,593,549 | 6/1986 | Moriya | 72/160 |
| 5,329,798 | 7/1994 | Takakura | 72/164 |
| 5,579,658 | 12/1996 | Noe | 72/161 |

FOREIGN PATENT DOCUMENTS

| | | | |
|---|---|---|---|
| A-263-971 | 4/1988 | European Pat. Off. . | |
| A-36-36-707 | 5/1988 | Germany . | |
| 193230 | 11/1982 | Japan | 72/164 |
| A-60-64728 | 4/1985 | Japan . | |
| A-62-114712 | 5/1987 | Japan . | |
| A-3-13229 | 1/1991 | Japan . | |
| A-4-237507 | 8/1992 | Japan . | |
| B2-6-245 | 1/1994 | Japan . | |

*Primary Examiner*—Daniel C. Crane

*Attorney, Agent, or Firm*—Oliff & Berridge, P.L.C.

[57] ABSTRACT

A bowing correction apparatus for a temper rolling mill corrects vertical bowing of a cold-rolled steel sheet. The bowing correction apparatus includes at least a first bowing correction auxiliary roll, first deflector roll, second deflector roll and second bowing correction auxiliary roll. These rolls are arranged in the running direction of the cold-rolled steel sheet and are alternately positioned on upper and lower sides of the cold-rolled steel sheet to correct bowing of the sheet.

15 Claims, 4 Drawing Sheets

BOWING CORRECTION APPARATUS FOR TEMPER ROLLING MILL

BACKGROUND OF THE INVENTION

1. Field of the Invention

The invention relates to a bowing correction apparatus for use in a temper rolling mill or a tempering rolling mill.

2. Description of the Related Art

Tempering rolling of a cold-rolled steel sheet to be used as a blank of a tin-plated steel sheet known as a "tin mill black plate" or a "black plate", is generally done by a temper rolling mill. A temper rolling mill includes a pair of stands, and a black plate has a relatively small thickness, in a range generally 0.15 mm to 0.60 mm. Thus, it can exhibit bowing after temper-rolling. Apparatus have been proposed to reduce bowing of a temper-rolled black plate, such as disclosed in Japanese Examined Patent Publication No. 6-245 (JP 245).

As shown in FIG. 4, the JP 245 apparatus includes a pair of vertically shiftable bowing correction auxiliary rolls e and f for reducing bowing. They are positioned between a work roll b of a stand a and a bridle roll c, and at an outlet side of the work roll b. In operation, the bowing correction auxiliary rolls e and f are vertically moved to vary an intermesh amount. Thereby, they remove vertical L-bowing (curl) in a longitudinal direction of the black plate, as well as vertical C-bowing (cross bow) in a widthwise direction of the black plate.

The term "intermesh" amount, for example an intermesh amount of the bowing correction auxiliary roll e, corresponds to a vertical distance (mm) at a point where the roll e contacts the steel sheet. It is measured from a level plane along which a steel sheet would run if it contacted the work roll b and bowing correction auxiliary roll e that are upstream and downstream, respectively, of the roll e to its level on the roll e.

The arrangement of the pair of bowing correction auxiliary rolls e and f between the work roll b and bridle roll c permits the bowing correction auxiliary roll e to be positioned close to the work roll b. Thus, it contacts a lower side of the cold rolled steel sheet d. The auxiliary roll f is positioned close to the bridle roll c and contacts an upper side of the cold-rolled steel sheet d. Thus, the cold-rolled steel sheet d partly contacts peripheral surfaces of auxiliary rolls e and f.

The JP 245 bowing correction apparatus suffers from several problems. For example, the bowing correction auxiliary roll e is assumed to be adjacent to the work roll b, so vertically shifting the bowing correction auxiliary roll e varies the intermesh amount with respect to the work roll b and bowing correction auxiliary roll f. A wrap angle of the cold-rolled steel sheet d on a peripheral surface of the bowing correction auxiliary roll f is changed to vary the other intermesh amount. An intermesh amount of the bowing correction roll f with respect to the bowing correction auxiliary roll e and bridle roll c can be varied. In other words, a change in the wrap angle of the cold-rolled steel sheet on a peripheral surface of the bowing correction auxiliary roll e simultaneously changes a wrap angle of the cold-rolled steel sheet on a peripheral surface of the bowing correction auxiliary roll f. This makes it difficult to properly correct upward or downward (vertical) bowing of the cold-rolled steel sheet.

Even a slight bowing leads to problems, especially in an extremely thin cold-rolled steel sheet. For instance, bowing tolerance is extremely severe in steel sheets used for cans, because such steel sheets are subjected to printing after tin plating. Bowing is measured while a steel sheet is in a freely suspended state, since a bowing amount cannot be accurately measured due to a deflection of the sample steel sheet caused by its weight when laid on a flat surface. For instance, in a sample steel sheet 800 mm long and 850 mm wide, the sample steel sheet is unacceptable when C-bowing (cross-bow), which is a depression amount of the breadthwise central portion with respect to both widthwise ends, exceeds 12 mm. Thus, problems have been encountered in correcting bowing to meet such strict requirements.

SUMMARY OF THE INVENTION

Accordingly, it is an object of the invention to provide a bowing correction apparatus for a temper rolling mill. The bowing correction apparatus reduces or removes vertical bowing from a cold-rolled steel sheet to overcome the above-described problems.

According to one preferred embodiment of the invention, a bowing correction apparatus for a temper rolling mill comprises a pair of vertically shiftable bowing correction auxiliary rolls, which are disposed between work rolls of a rolling stand and a bridle roll on the temper rolling mill. The pair of vertically shiftable bowing correction auxiliary rolls are positioned downstream of the work rolls in a sheet running direction and spaced at a distance from each other. Thus the cold rolled steel sheet is wound on peripheral surfaces over areas on the circumferences of the pair of bowing correction auxiliary rolls. Thus, bowing of the cold-rolled steel sheet can be corrected when the pair of bowing correction auxiliary rolls are vertically shifted.

The bowing correction apparatus also includes a plurality of rotatable stationary deflector rolls disposed between the pair of bowing correction auxiliary rolls to vertically alter the running direction of the cold-rolled steel sheet. The pair of bowing correction auxiliary rolls and the plurality of deflector rolls are arranged in the sheet running direction, so successive ones of the rolls are alternately positioned on upper and lower sides of the cold-rolled steel sheet.

These and other objects, features and advantages will become clear from the following description of the preferred embodiments taken in conjunction with the accompanying drawings.

BRIEF DESCRIPTION OF THE DRAWINGS

The invention will be described in detail with reference to the following drawings, in which like reference numerals refer to like elements and wherein.

DESCRIPTION OF THE PREFERRED EMBODIMENT

Figure 1:
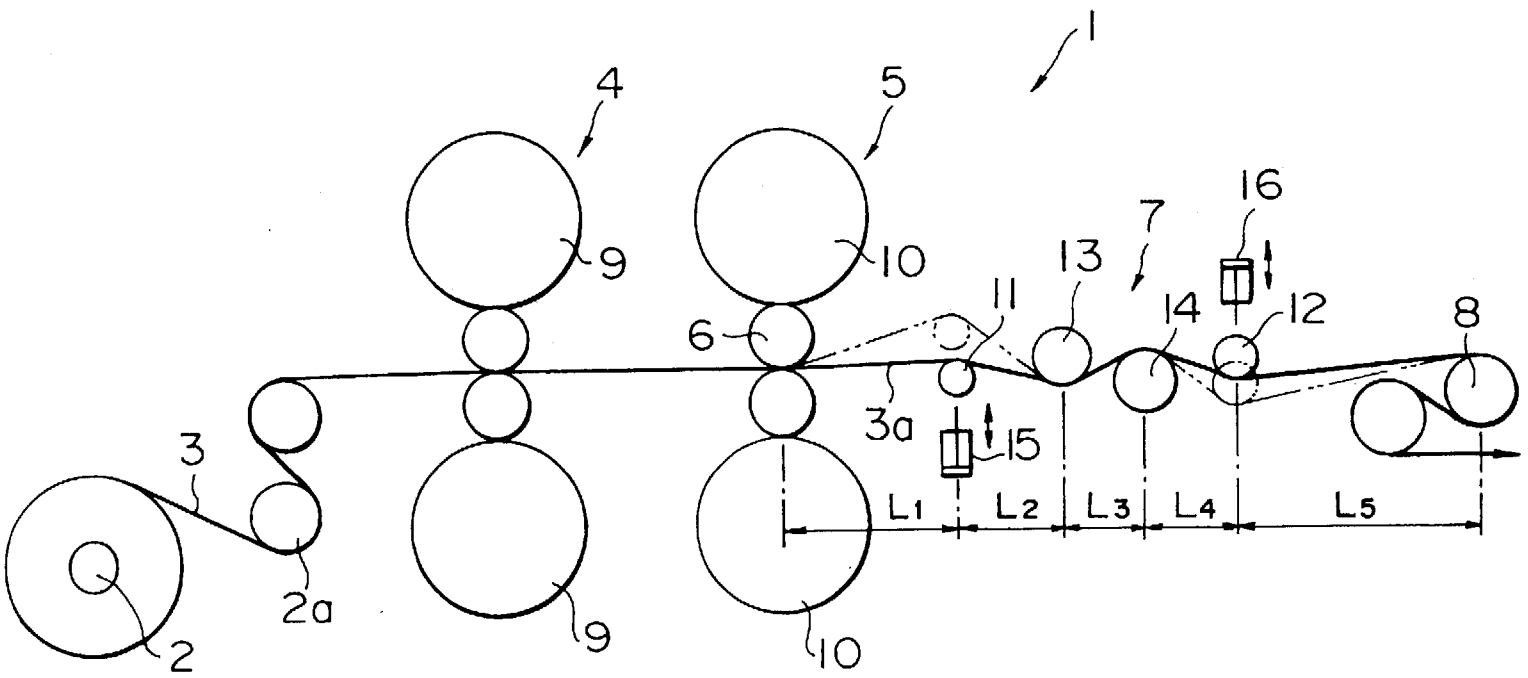
FIG. 1 is a schematic side schematic elevational view of a temper rolling mill according to a first preferred embodiment of a bowing correction apparatus of the invention.

According to preferred embodiments of the invention, a bowing correction apparatus for a temper rolling mill comprises a pair of vertically shiftable bowing correction auxiliary rolls, which are disposed between work rolls of a rolling stand and a bridle roll on the temper rolling mill. The pair of vertically shiftable bowing correction auxiliary rolls are positioned downstream of the work rolls in a sheet running direction and spaced at a distance from each other. Thus the cold rolled steel sheet is wound on peripheral surfaces over areas on the circumferences of the pair of bowing correction auxiliary rolls. Thus, bowing of the cold-rolled steel sheet can be corrected when the pair of bowing correction auxiliary rolls are vertically shifted.

The pair of bowing correction auxiliary rolls and deflector rolls satisfy conditions:

$1.5 \leqq L_2/D \leqq 3$ and $1.5 \leqq L_4/D \leqq 3$, where $L_2$ is a horizontal distance between a center or center axis of the bowing correction auxiliary roll that is adjacent the work rolls and the deflector roll that is adjacent the work rolls; $L_4$ is a horizontal distance between a center or center axis of the bowing correction auxiliary roll that is adjacent the bridle roll and the deflector roll adjacent the bridle roll; and D is a diameter for each bowing correction auxiliary roll.

Further, the pair of bowing correction auxiliary rolls and the deflector rolls are positioned to satisfy conditions:

$L_1/D \geqq 3$ and $L_5/D \geqq 3$, wherein $L_1$ is a horizontal distance between a center or center axis of the work rolls and the bowing correction auxiliary roll that is adjacent the work rolls and $L_5$ is a horizontal distance between a center or center axis of the bridle roll and bowing correction auxiliary roll that is adjacent the bridle roll.

The plurality of stationary deflector rolls rotate about their center or center axis, and are disposed between the pair of bowing correction auxiliary rolls. The pair of bowing correction auxiliary rolls and the plurality of deflector rolls are arranged in a sheet running direction, so that successive ones of the rolls are alternatively positioned on upper and lower sides of the cold-rolled steel sheet. Therefore, it is possible to vertically shift the bowing correction auxiliary roll that is adjacent the work rolls and the bowing correction auxiliary roll that is adjacent the bridle roll to vary an intermesh amount, without changing an intermesh amount for the other bowing correction auxiliary roll. The intermesh amount of each bowing correction auxiliary roll can be independently controlled with respect to the other bowing correction auxiliary roll, without changing an arc over which the cold-rolled steel sheet contacts the periphery of the other bowing correction auxiliary roll.

When conditions:

$1.5 \leqq L_2/D \leqq 3$ and $1.5 \leqq L_4/D \leqq 3$ are met, the distance between the bowing correction auxiliary roll that is adjacent the work rolls and the deflector roll adjacent to the work roll, as well as the distance between the bowing correction auxiliary roll that is adjacent the bridle roll to permit a beneficial arrangement of the temper rolling mill.

When $L_2/D$ or $L_4/D$ is less than 1.5, it is difficult to mount a lifting device, which can vertically shift each bowing correction auxiliary roll, because a space between the bowing correction auxiliary roll and the deflector roll is too small to accommodate a lifting device. Conversely, when the ratio $L_2/D$ or $L_4/D$ is greater than 3, the distance between the bowing correction auxiliary roll and the deflector roll is such that a lifting device needs a large stroke to obtain a required intermesh amount. Thus, an enlarged lifting device is needed with an associated rise in the installation cost.

When $L_1/D \geqq 3$ or $L_1 \geqq 3D$, it is possible to reduce the uni-directional or single-sided bowing amount of the black plate. For example, the difference between the amount of L-bowing occurring at an operation side of the bowing correction auxiliary roll and that occurring at a driving side, as well as reducing any twisting of the cold-rolled steel sheet that tends to occur due to mis-alignment between the work rolls and the bowing correction auxiliary rolls. It is thus possible to properly and effectively perform a bowing correcting operation.

Similarly, when $L_5/D \geqq 3$ or $L_5 \geqq 3D$, a proper and effective bowing correcting operation can be achieved by the bowing correction roll that is adjacent the bridle roll. This is achieved through a reduction of uni-directional or single-sided bowing and twisting of the cold-rolled steel sheet that can be attributed to mis-alignment between a bridle roll and bowing correction roll. The mis-alignment can be caused by ineffective mounting of the bridle roll.

When $L_1/D$ is less than 3, the spacing between the work rolls and bowing correction auxiliary roll that is adjacent the work rolls is small. The influence of a mis-alignment is increased allowing large amount of uni-directional or single-sided bowing and twisting in the cold-rolled steel sheet. This hampers bowing correcting operations of the bowing correction auxiliary rolls.

When $L_5/D$ is less than 3, the spacing between the bridle roll and bowing correction auxiliary roll that is adjacent the bridle roll is small. The influence of the mis-alignment is increased allowing large uni-directional or single-sided bowing and twisting of the cold-rolled steel sheet. This hampers a bowing correcting operation performed by the bowing correction auxiliary rolls.

A first preferred embodiment of the invention will now be described with reference to FIGS. 1 through 3.

FIG. 1 illustrates a temper rolling mill 1. The temper rolling mill 1 comprises a black plate 3, which is a steel sheet that can be tin-plated. The black plate 3 is uncoiled from a pay-off reel 2, and is introduced by a tension roll 2*a* into a first rolling stand 4 and a second rolling stand 5. The black plate 3 is cold-rolled through first and second rolling stands 4 and 5 to become a cold-rolled black plate 3*a*.

Vertical bowing, including L-bowing (curl) and C-bowing (cross bow) of the cold-rolled black plate 3*a*, is corrected by a bowing correction apparatus 7. The bowing correction apparatus 7 is downstream in the black plate running direction from work rolls 6 of the second rolling stand 5. The black plate 3*a*, after bowing correction, is then taken up by a tension roll (not illustrated) after passing through a bridle roll 8. Backup rolls 9 and 10 contact work rolls 6. A work roll driving system or a backup roll driving system may be used as a temper rolling mill driving system. Alternatively, other appropriate driving systems may be used.

A description of the bowing correction apparatus 7 will now be provided. The bowing correction apparatus 7 includes a pair of bowing correction auxiliary rolls 11 and 12. The pair of bowing correction auxiliary rolls 11 and 12 are rotatably disposed between work rolls 6 of the second rolling stand 5 and the bridle roll 8. The pair of bowing correction auxiliary rolls 11 and 12 are spaced from each other in the running direction of the black plate 3*a*.

Both bowing correction auxiliary rolls 11 and 12 are vertically shiftable. In the first preferred embodiment, the bowing correction auxiliary roll 11 that is adjacent the work roll 6 engages a lower side of the black plate 3*a* over an arcuate portion of its peripheral surface. The bowing correction auxiliary roll 12 that is adjacent the bridle roll 8 engages an upper side of the black plate 3*a* over an arcuate portion of its peripheral surface. The black plate 3*a* is thus "wound" on peripheral surfaces of the pair of bowing correction auxiliary rolls 11 and 12.

The pair of bowing correction auxiliary rolls 11 and 12 can be moved vertically, i.e. up and down in FIG. 1, independently of each other by associated lifting structures, such as lifting devices 15 and 16. (The terms up and down are used to describe the bowing correction auxiliary rolls 11 and 12 as illustrated in FIG. 1. However, this is not meant to limit the orientation of the bowing correction auxiliary rolls 11 and 12, which can be mounted in any orientation, as long as it corrects L-bowing (curl) and C-bowing (cross bow)). These lifting devices 15 and 16 may be electrical, hydraulic or any other appropriate lifting device.

In operation, the pair of bowing correction auxiliary rolls 11 and 12 are vertically shifted to vary an intermesh amount for each of the bowing correction auxiliary rolls 11 and 12. This corrects L-bowing (curl) and C-bowing (cross bow) for the black plate 3*a*.

A pair of deflector rolls 13 and 14 deflect the black plate 3*a*, for example, in a vertical or up and down direction, as seen in FIG. 1. The pair of deflector rolls 13 and 14 are positioned between the pair of bowing correction auxiliary rolls 11 and 12, and are spaced from each other in the running direction of the black plate 3*a*. The deflector rolls 13 and 14 are rotatable about their center axes, however they are stationary, with respect to the mill 1. The diameters of the deflector rolls 13 and 14 are greater than the diameters of the pair of bowing correction auxiliary rolls 11, 12. Although two deflector rolls are shown, any number of deflector rolls could be used.

The deflector roll 13, which is adjacent the work roll 6, engages an upper surface of the black plate 3*a*, and defines an apex or point of contact with the black plate 3*a* that is below an apex or point of contact between the black plate 3*a* and the bowing correction auxiliary roll 11. The deflector roll 14, which is adjacent the bridle roll 8, engages a lower surface of the black plate 3*a*, and defines an apex or point of contact with the black plate 3*a* that is above an apex or point of contact between the black plate 3*a* and the bowing correction roll 12.

The black plate 3*a* contacts the deflector rolls 13 and 14 over an elongated circumference of the rolls 13 and 14, in a similar manner as it contacts the pair of bowing correction auxiliary rolls 11 and 12. The running direction of the black plate 3*a* undergoes height or elevational changes when it contacts the deflector rolls 13 and 14. The rolls, including the bowing correction roll 11, deflector roll 13, deflector roll 14 and bowing correction roll 12, are alternately positioned on upper and lower sides of the black plate 3*a* in the running direction of the black plate 3*a* as shown in FIG. 1, so that successive ones of the rolls contact upper and lower surfaces of the black plate 3*a*.

The deflector rolls 13 and 14, which are positioned between the pair of bowing correction auxiliary rolls 11 and 12, permit a vertical shifting of the black plate 3*a*, and change an intermesh amount for each of the bowing correction auxiliary rolls 11 and 12. Bowing correction of the black plate 3*a* can thus occur without a change in an arc or degree that the black plate 3*a* is wound on the peripheral surface of the pair of bowing correction auxiliary rolls 11 and 12. It is possible to independently change an intermesh amount for the bowing correction auxiliary roll 11 that is adjacent the work roll 6 and to independently change an intermesh amount for the bowing correction auxiliary roll 12 that is adjacent the bridle roll 8. Thus, the bowing correction by each of the bowing correction auxiliary rolls 11 and 12 can be effectively and independently conducted without effecting the intermesh amount of the other bowing correction auxiliary roll.

The rolls 11, 13, 14 and 12 are spaced to satisfy conditions:

$1.5 \leqq L_2/D \leqq 3$, and $1.5 \leqq L_4/D \leqq 3$, where $L_2$ is a horizontal distance between a center or center axis of the bowing correction auxiliary roll 11 and deflector roll 13; $L_4$ is a horizontal distance between a center or center axis of the bowing correction auxiliary roll 12 and deflector roll 14; and D is a diameter of each bowing correction auxiliary roll 11 and 12.

When $L_2/D$ is less than 1.5, the spacing between the bowing correction auxiliary roll 11 and the deflector roll 13 is small, so it is difficult to mount the lifting device 15 for the bowing correction auxiliary roll 11. When $L_2/D$ is greater than 3, the spacing between the bowing correction auxiliary roll 11 and deflector roll 13 is large, so an impractically large stroke of the lifting device 15 is needed for a desired intermesh amount of the bowing correction auxiliary roll 11. Thus, a large-scale lifting apparatus would be required that would raise the installation cost.

If $L_4/D$ is less than 1.5, the spacing between the bowing correction auxiliary roll 12 and deflector roll 14 is small, so mounting of the lifting device 16 for the bowing correction auxiliary roll 12 is difficult. If $L_4/D$ is greater than 3, the spacing between the bowing correction auxiliary roll 12 and deflector roll 14 is large, so an impractically large stroke of a lifting device 16 is needed for a desired intermesh amount of the bowing correction auxiliary roll 12. Thus, a large-scale lifting apparatus would be required that would raise the installation cost.

Therefore, arranging the rolls 11, 13, 14 and 12 to simultaneously satisfy conditions:

$1.5 \leqq L_2/D \leqq 3$ and $1.5 \leqq L_4/D \leqq 3$, facilitates mounting of the lifting devices 15 and 16, and enables relatively small lifting devices to provide a desired intermesh amount. This also prevents a substantial rise in the installation costs.

The work rolls 6 of the second rolling stand 5 require periodical renewal or replacement. However, uni-directional or single-sided bowing or twisting of the black plate 3*a* may be caused after the renewal or replacement of the work rolls 6, due to mis-alignment or improper alignment of the work rolls 6. This is especially evident if the work rolls 6 are not parallel with respect to the bowing correction auxiliary roll 11, both vertically and horizontally.

Uni-directional or single-sided bowing or twisting of the black plate 3*a* can also be caused by inferior mounting of the bridle roll 8, due to mis-alignment or improper alignment of the bridle roll 8 and bowing correction auxiliary roll 12, both vertically and horizontally.

Mis-alignment between the work rolls 6 and bowing correction auxiliary roll 11 is increased when the distance between these rolls 6 and 11 is small. This results in an increased uni-directional or single-sided bowing and twisting of the black plate 3*a*, where they cooperate. Similarly, too small of a distance between the bridle roll 8 and bowing correction auxiliary roll 12 can result in an increased influence of mis-alignment, increasing uni-directional or single-sided bowing and twisting of the black plate 3*a*, where these rolls 8 and 12 cooperate. Consequently, correction of vertical bowing of the black plate 3a by the pair of bowing correction auxiliary rolls 11 and 12 is difficult due to uni-directional or single-sided bowing and twisting of the black plate 3a, despite independently controlling the intermesh amounts of the pair of bowing correction auxiliary rolls 11 and 12.

In view of this and other difficulties, in the first preferred embodiment, a distance $L_1$ between a center or the center axis of the work rolls 6 and bowing correction auxiliary roll 11 and a distance $L_5$ between a center or center axis of the bridle roll 8 and bowing correction auxiliary roll 12 are determined with respect to the diameter D of the pair of bowing correction auxiliary rolls 11 and 12. These distances and diameters are provided so conditions:

$L_1/D \geqq 3$ and $L_5/D \geqq 3$ are satisfied. This minimizes an influence of any mis-alignment of the work rolls 6 and bridle roll 8 with each of the pair of bowing correction auxiliary rolls 11 and 12, respectively.

Figure 2:
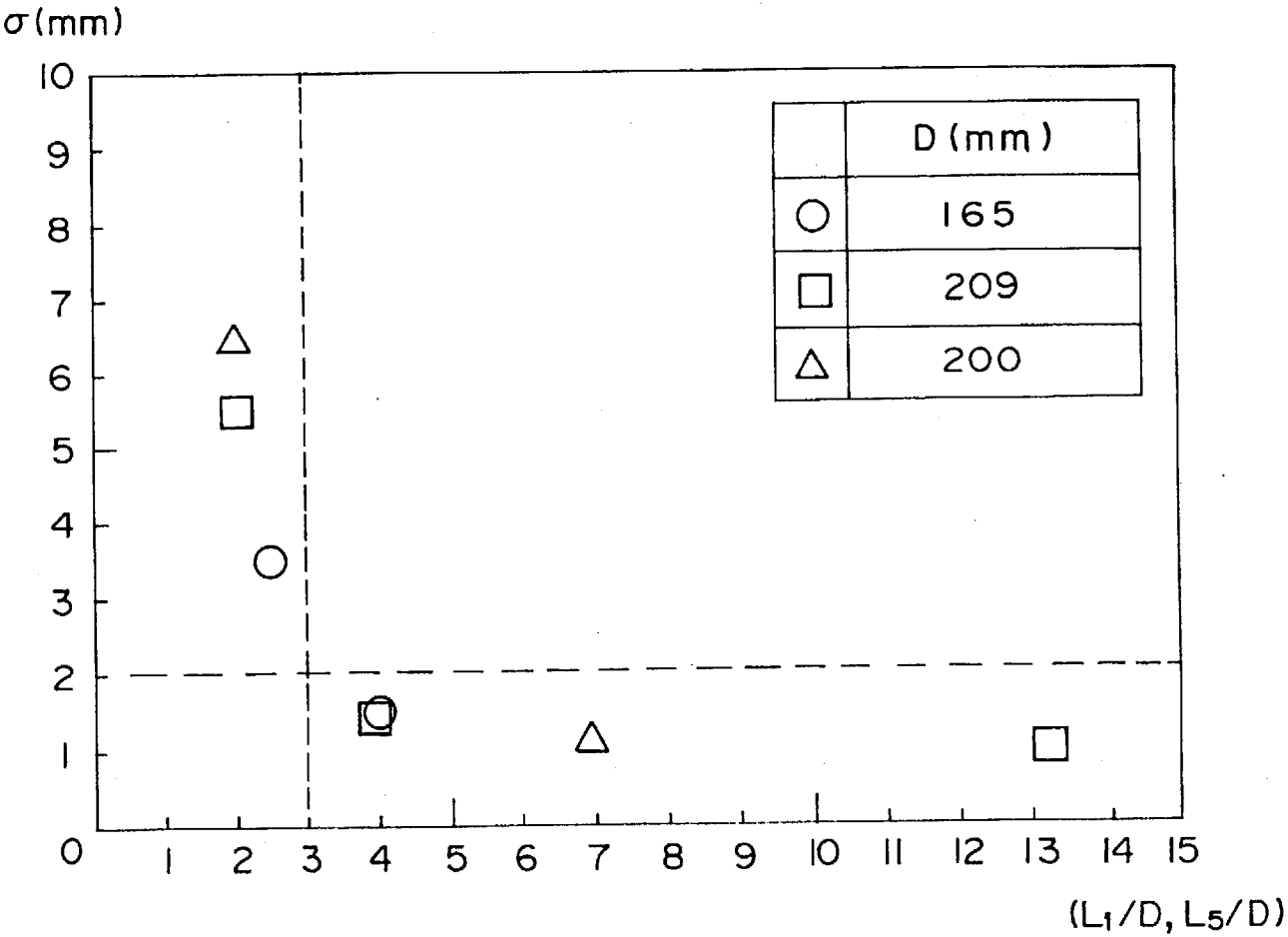
FIG. 2 is a graph illustrating a relationship between a variation (standard deviation) $\sigma$ of a uni-directional or single-sided bow of a black plate, shown by the ordinate axis, and ratios $L_1/D$ and $L_5/D$ for $L_1$, $L_5$ and D, shown in FIG. 1.
Figure 3:
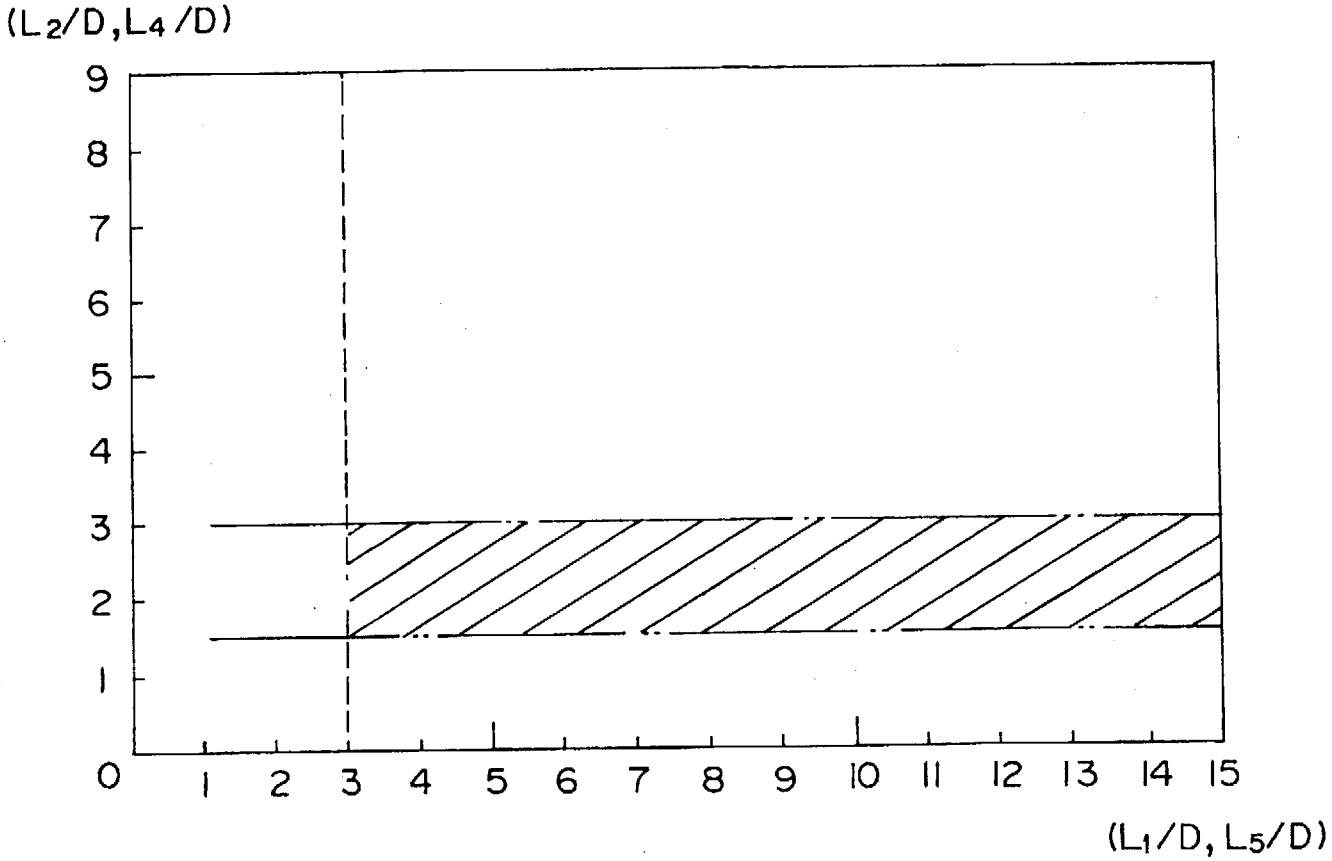
FIG. 3 is a graph illustrating a region that satisfies conditions $1.5D \leqq L_2 \leqq 3D$, $1.5D \leqq L_4 \leqq 3D$, $L_1 \geqq 3D$ and $L_5 \geqq 3D$, wherein the vertical axis represents the values of the ratios $L_2/D$ and $L_4/D$, while the horizontal axis represents values of $L_1/D$ and $L_5/D$.
Figure 4:
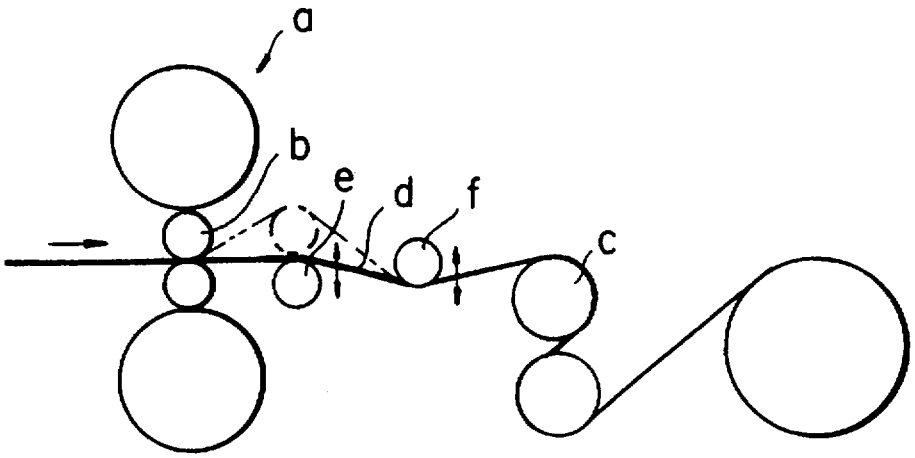
FIG. 4 PRIOR ART
FIG. 4 is a schematic side elevational view of a conventional bowing correction apparatus of a temper rolling mill.

FIGS. 2 and 3 are graphs illustrating results of tests conducted by the inventors. In FIG. 2, the vertical axis indicates a variation or standard deviation $\sigma$ of uni-directional or single-sided bowing of the black plate 3a. The horizontal axis represents $L_1/D$ and $L_5/D$. Three different pairs of bowing correction auxiliary rolls and 12 with diameters D of 165 mm, 209 mm and 200 mm, respectively, were tested. The pair of bowing correction auxiliary rolls 11 and 12 are most commonly used in tempering rolling of black plates 3a with thicknesses between generally 0.15 mm and 0.60 mm.

As seen in FIG. 2, the variation $\sigma$ of uni-directional or single-sided bow exceeds 3 mm due to distances between the work rolls 6 and bowing correction auxiliary roll 11 and between the bridle roll 8 and the bowing correction roll 12 being too small. This is regardless of the diameter of the pair of bowing correction auxiliary rolls 11 and 12, when $L_1/D$ and $L_5/D$ were less than 3.

Conversely, when $L_1/D$ and $L_5/D$ were equal to or greater than 3, i.e., when $L_1/D \geqq 3$ and $L_5/D \geqq 3$ were simultaneously satisfied, the variation $\sigma$ of uni-directional or single-sided bow was less than 2 mm, regardless of the diameter D. This is due to a reduced influence of mis-alignment between the work rolls 6 and bowing correction auxiliary roll 11 and between the bridle roll 8 and bowing correction auxiliary roll 12.

Thus, by determining a distance $L_1$ between a center or center axis of the work rolls 6 and a center or center axis of the bowing correction auxiliary roll 11 and a distance $L_5$ between a center or center axis of the bridle roll 8 and the bowing correction auxiliary roll 12 to satisfy conditions:

$L_1/D \geqq 3$ and $L_5/D \geqq 3$, it is possible to reduce the influence of mis-alignment. This also facilitates bowing correction performed by the pair of bowing correction auxiliary rolls 11 and 12.

In FIG. 3, the vertical axis represents $L_2/D$ and $L_4/D$, while the horizontal axis represents $L_1/D$ and $L_5/D$. The hatched region in FIG. 3 simultaneously satisfies conditions $1.5D \leqq L_2 \leqq 3D$, $1.5D \leqq L_4 \leqq 3D$, $L_1 \leqq 3D$ and $L_5 \leqq 3D$. The data in FIG. 3 was obtained with the pair of bowing correction auxiliary rolls 11 and 12 having a diameter D of 200 mm, deflector rolls 13 and 14 having a diameter of 300 mm, roll distances of $L_1$=800 mm, $L_2$=500 mm, $L_4$=400 mm and $L_5$=2600 mm, and the horizontal distance $L_3$, between the deflector rolls 13 and 14, equal to 350 mm.

As will be understood from the foregoing description, the pair of bowing correction auxiliary rolls enables intermesh amounts to be controlled independent of each other. Accordingly, it is possible to correct vertical (upward and downward in FIG. 1) bowing of the cold-rolled steel sheet using respective ones of the pair of bowing correction auxiliary rolls 11 and 12.

When the rolls are arranged such that conditions $1.5 \leqq L_2/D \leqq 3$ and $1.5 \leqq L_4/D \leqq 3$ are simultaneously satisfied, it is possible to easily mount lifting devices 15 and 16 associated with respective ones of the pair of bowing correction auxiliary rolls 11 and 12. This also permits small-sized lifting devices to be provided. Thus, the installation costs are relatively low.

When conditions $L_1/D \leqq 3$ and $L_5/D \leqq 3$ are met, the influence of mis-alignment due to inferior mounting of the work roll 6 and/or bridle roll 8 can be diminished in a bowing correcting operation. This enables the bowing correction auxiliary rolls to properly and effectively correct upward and downward bowing of the cold-rolled steel sheet.

While this invention has been described in conjunction with specific embodiments thereof, it is evident that many alternatives, modifications and variations will be apparent to those skilled in the art. Accordingly, the preferred embodiments of the invention as set forth here are intended to illustrative, not limiting. Various changes may be made without departing from the spirit and scope of the invention as defined in the following claims.

What is claimed is:

1. A bowing correction apparatus for a temper rolling mill, the temper rolling mill including a bridle roll and a rolling stand having work rolls, the bridle roll being positioned downstream of the work rolls in a running direction of running of a cold-rolled steel sheet; the bowing correction apparatus comprising:

a pair of vertically shiftable bowing correction auxiliary rolls being positioned between the work rolls and the bridle roll, the cold-rolled steel sheet contacting circumferential portions of said pair of bowing correction auxiliary rolls to correct bowing of the cold-rolled steel sheet when at least one of said pair of bowing correction auxiliary rolls is vertically shifted; and a plurality of deflector rolls positioned between said pair of bowing correction auxiliary rolls, said plurality of deflector rolls altering the running direction of the cold-rolled steel sheet, said pair of bowing correction auxiliary rolls and said plurality of deflector rolls being arranged in the running direction of the cold-rolled steel sheet such that successive ones of said pair of bowing correction auxiliary rolls and said plurality of deflector rolls are alternately positioned on upper and lower surfaces of the cold-rolled steel sheet, wherein said pair of bowing correction auxiliary rolls and said plurality of deflector rolls are spaced from each other and satisfy conditions:

$1.5 \leqq L_2/D \leqq 3$ and $1.5 \leqq L_4/D \leqq 3$, where $L_2$ is a horizontal distance a between center of a bowing correction auxiliary roll of said pair of bowing correction auxiliary rolls that is adjacent said work rolls and a deflector roll of said plurality of deflector rolls that is adjacent the work rolls, $L_4$ is a horizontal distance between a center of the other of said pair of bowing correction auxiliary rolls that is adjacent the bridle roll and another of said plurality of deflector rolls that is adjacent the bridle roll, and D is a diameter for each of said pair of bowing correction auxiliary rolls.

2. A bowing correction apparatus according to claim 1, wherein said pair of bowing correction auxiliary rolls and said plurality of deflector rolls further satisfy conditions:

$L_1/D \geqq 3$ and $L_5/D \geqq 3$, wherein $L_1$ is a horizontal distance between centers of the work rolls and the bowing correction auxiliary roll that is adjacent the work rolls, and $L_5$ is a horizontal distance between centers of the bridle roll and said other bowing correction auxiliary roll that is adjacent the bridle roll.

3. A bowing correction apparatus according to claim 1, wherein said pair of bowing correction auxiliary rolls and said plurality of deflector rolls satisfy conditions:

$L_1/D \geqq 3$ and $L_5/D \geqq 3$, wherein $L_1$ is a horizontal distance between centers of the work rolls and the bowing correction auxiliary roll that is adjacent the work rolls, $L_5$ is a horizontal distance between centers of the bridle roll and said other bowing correction auxiliary roll that is adjacent the bridle roll, and D is a diameter for each of said pair of bowing correction auxiliary rolls.

4. A bowing correction apparatus according to claim 1, wherein the said plurality of deflector rolls rotate about a stationary center axis.

5. A temper rolling mill, the temper rolling mill comprising:

a rolling stand having work rolls;

a bridle roll;

the bridle roll being positioned downstream of the work rolls in the running direction of a cold-rolled steel sheet; and a bowing correction apparatus comprising:

a pair of shiftable bowing correction auxiliary rolls being positioned between said work rolls and said bridle roll, the cold-rolled steel sheet contacting circumferential portions of said pair of bowing correction auxiliary rolls to correct bowing of the cold-rolled steel sheet when at least one of said pair of bowing correction auxiliary rolls are shifted; and a plurality of deflector rolls being positioned between said pair of bowing correction auxiliary rolls, said plurality of deflector rolls altering the running direction of the cold-rolled steel sheet, said pair of bowing correction auxiliary rolls and said plurality deflector rolls being arranged in the running direction of the cold-rolled steel sheet such that successive ones of said pair of bowing correction auxiliary rolls and said plurality of deflector rolls are alternately positioned on upper and lower surfaces of the cold-rolled steel sheet, wherein said pair of bowing correction auxiliary rolls and said plurality deflector rolls are spaced from each other and satisfy conditions:

$1.5 \leqq L_2/D \leqq 3$ and $1.5 \leqq L_4/D \leqq 3$, where $L_2$ is a distance between centers of a bowing correction auxiliary roll of said pair of bowing correction auxiliary rolls that is adjacent said work rolls and a deflector roll of said plurality of deflector rolls that is adjacent said work rolls, $L_4$ is a distance between centers of said other of said pair of bowing correction auxiliary rolls that is adjacent said bridle roll and another of said plurality of deflector rolls that is adjacent said bridle roll, and D is a diameter for each of said pair of bowing correction auxiliary rolls.

6. A temper rolling mill according to claim 5, wherein said pair of bowing correction auxiliary rolls and said plurality of deflector rolls further satisfy conditions:

$L_1/D \geqq 3$ and $L_5/D \geqq 3$, wherein $L_1$ is a distance between centers of said work rolls and said bowing correction auxiliary roll that is adjacent the work rolls, of is a distance between centers of said bridle roll and said other bowing correction auxiliary roll that is adjacent said bridle roll.

7. A temper rolling mill according to claim 5, wherein said pair of bowing correction auxiliary rolls and said plurality of deflector rolls satisfy conditions:

$L_1/D \geqq 3$ and $L_5/D \geqq 3$, wherein $L_1$ is a distance between centers of said work rolls and the bowing correction auxiliary roll that is adjacent said work rolls, $L_5$ is a distance between centers of said bridle roll and said other bowing correction auxiliary roll that is adjacent said bridle roll.

8. A temper rolling mill according to claim 5, wherein said plurality of deflector rolls rotate about a stationary center and D is a diameter for each of said pair of bowing correction auxiliary rolls.

9. A bowing correction apparatus for a temper rolling mill, the temper rolling mill including a bridle roll and a rolling stand having work rolls, the bridle roll being positioned downstream of the work rolls in the running direction of running of a cold-rolled steel sheet; the bowing correction apparatus comprising:

shiftable bowing correction means for correcting bowing of the cold-rolled steel positioned between the work rolls and the bridle roll, said cold rolled steel sheet contacting circumferential portions of said bowing correction means; and deflector means being positioned between said bowing correction means for altering a running direction of the cold-rolled steel sheet, said bowing correction means and said deflector means being arranged in the running direction of the cold-rolled steel sheet such that successive ones of said means are alternately positioned on upper and lower surfaces of the cold-rolled steel sheet, wherein said bowing correction means and said deflector means are spaced from each other, each of said bowing correction means and said deflector means comprise at least two rolls, and satisfy conditions:

$1.5 \leqq L_2/D \leqq 3$ and $1.5 \leqq L_4/D \leqq 3$, where $L_2$ is a distance between centers of one roll of said bowing correction means adjacent said work rolls and one roll of said deflector means that is adjacent the work rolls, $L_4$ is a distance between centers of another roll of said bowing correction means that is adjacent the bridle roll and another roll of said deflector means that is adjacent the bridle roll, and D is a diameter of each roll of said bowing correction means.

10. A bowing correction apparatus according to claim 9, wherein said bowing correction means and said deflector means further satisfy conditions:

$L_1/D \geqq 3$ and $L_5/D \geqq 3$, wherein $L_1$ is a distance between centers of the work rolls and said one roll of said bowing correction means that is adjacent the work rolls, $L_5$ is a distance between centers of the bridle roll and said another roll of said bowing correction means that is adjacent the bridle roll.

11. A bowing correction apparatus according to claim 11, wherein said bowing correction means and said deflector means are spaced from each other and each comprises at least two rolls; said bowing correction means $L_1/D \geqq 3$ and $L_5/D \geqq 3$, wherein $L_1$ is a distance between centers of the work rolls and one roll of said bowing correction means that is adjacent the work rolls, $L_5$ is a distance between centers of the bridle roll and another roll of said bowing correction means that is adjacent the bridle roll, and D is a diameter of each roll of said bowing correction means.

12. A bowing correction apparatus for a temper rolling mill, the temper rolling mill including a bridle roll and a rolling stand having work rolls, the bridle roll being positioned downstream of the work rolls in a running direction of running of a cold-rolled steel sheet; the bowing correction apparatus comprising:

a pair of vertically shiftable bowing correction auxiliary rolls being positioned between the work rolls and the bridle roll, the cold-rolled steel sheet contacting circumferential portions of said pair of bowing correction auxiliary rolls to correct bowing of the cold-rolled steel sheet when at least one of said pair of bowing correction auxiliary rolls are vertically shifted; and a plurality of deflector rolls being positioned between said pair of bowing correction auxiliary rolls, said plurality of deflector rolls altering the running direction of the cold-rolled steel sheet, said pair of bowing correction auxiliary rolls and said plurality of deflector rolls being arranged in the running direction of the cold-rolled steel sheet such that successive ones of said pair of bowing correction auxiliary rolls and said plurality of deflector rolls are alternately positioned on upper and lower surfaces of the cold-rolled steel sheet, wherein said pair of bowing correction auxiliary rolls and said plurality of deflector rolls satisfy conditions:

$L_1/D \geqq 3$ and $L_5/D \geqq 3$, wherein $L_1$ is a horizontal distance between centers of the work rolls and the bowing correction auxiliary roll that is adjacent the work rolls, $L_5$ is a horizontal distance between centers of the bridle roll and said other bowing correction auxiliary roll that is adjacent the bridle roll, and D is a diameter for each of said pair of bowing correction auxiliary rolls.

13. A temper rolling mill, the temper rolling mill comprising:

a rolling stand having work rolls;

a bridle roll;

the bridle roll being positioned downstream of the work rolls in the running direction of a cold-rolled steel sheet; and a bowing correction apparatus comprising:

a pair of shiftable bowing correction auxiliary rolls being positioned between said work rolls and said bridle roll, the cold-rolled steel sheet contacting circumferential portions of said pair of bowing correction auxiliary rolls to correct bowing of the cold-rolled steel sheet when at least one of said pair of bowing correction auxiliary rolls are shifted; and a plurality of deflector rolls being positioned between said pair of bowing correction auxiliary rolls, said plurality of deflector rolls altering the running direction of the cold-rolled steel sheet, said pair of bowing correction auxiliary rolls and said plurality deflector rolls being arranged in the running direction of the cold-rolled steel sheet such that successive ones of said pair of bowing correction auxiliary rolls and said plurality of deflector rolls are alternately positioned on upper and lower surfaces of the cold-rolled steel sheet, wherein said pair of bowing correction auxiliary rolls and said plurality of deflector rolls satisfy conditions:

$L_1/D \geqq 3$ and $L_5/D \geqq 3$, wherein $L_1$ is a distance between centers of said work rolls and the bowing correction auxiliary roll that is adjacent said work rolls, $L_5$ is a distance between centers of said bridle roll and said other bowing correction auxiliary roll that is adjacent said bridle roll.

14. A temper rolling mill, the temper rolling mill comprising:

a rolling stand having work rolls;

a bridle roll;

the bridle roll being positioned downstream of the work rolls in the running direction of a cold-rolled steel sheet; and a bowing correction apparatus comprising:

a pair of shiftable bowing correction auxiliary rolls being positioned between said work rolls and said bridle roll, the cold-rolled steel sheet contacting circumferential portions of said pair of bowing correction auxiliary rolls to correct bowing of the cold-rolled steel sheet when at least one of said pair of bowing correction auxiliary rolls are shifted; and a plurality of deflector rolls being positioned between said pair of bowing correction auxiliary rolls, said plurality of deflector rolls altering the running direction of the cold-rolled steel sheet, said pair of bowing correction auxiliary rolls and said plurality deflector rolls being arranged in the running direction of the cold-rolled steel sheet such that successive ones of said pair of bowing correction auxiliary rolls and said plurality of deflector rolls are alternately positioned on upper and lower surfaces of the cold-rolled steel sheet, wherein said plurality of deflector rolls rotate about a stationary center and D is a diameter for each of said pair of bowing correction auxiliary rolls.

15. A bowing correction apparatus for a temper rolling mill, the temper rolling mill including a bridle roll and a rolling stand having work rolls, the bridle roll being positioned downstream of the work rolls in the running direction of running of a cold-rolled steel sheet; the bowing correction apparatus comprising:

shiftable bowing correction means for correcting bowing of the cold-rolled steel positioned between the work rolls and the bridle roll, said cold rolled steel sheet contacting circumferential portions of said bowing correction means; and deflector means being positioned between said bowing correction means for altering a running direction of the cold-rolled steel sheet, said bowing correction means and said deflector means being arranged in the running direction of the cold-rolled steel sheet such that successive ones of said means are alternately positioned on upper and lower surfaces of the cold-rolled steel sheet, wherein said bowing correction means and said deflector means are spaced from each other and each comprises at least two rolls; said bowing correction means and said deflector means satisfy conditions:

$L_1/D \geqq 3$ and $L_5/D \geqq 3$, wherein $L_1$ is a distance between centers of the work rolls and one roll of said bowing correction means that is adjacent the work rolls, $L_5$ is a distance between centers of the bridle roll and another roll of said bowing correction means that is adjacent the bridle roll, and D is a diameter of each roll of said bowing correction means.

* * * * *